US007926536B2

(12) United States Patent
Fox et al.

(10) Patent No.: US 7,926,536 B2
(45) Date of Patent: Apr. 19, 2011

(54) SPRING TENSION CONTROL SYSTEM FOR THE TAPE APPLICATION ROLLERS OF A TAPE ROLL DISPENSING CARTRIDGE ASSEMBLY

(75) Inventors: Bryce J. Fox, Honesdale, PA (US); William J. Menta, West Wyoming, PA (US)

(73) Assignee: Illinois Tool Works Inc., Glenview, IL (US)

( * ) Notice: Subject to any disclaimer, the term of this patent is extended or adjusted under 35 U.S.C. 154(b) by 533 days.

(21) Appl. No.: 12/073,143

(22) Filed: Feb. 29, 2008

(65) Prior Publication Data

US 2009/0218047 A1 Sep. 3, 2009

(51) Int. Cl.

| | |
|---|---|
| ***B29C 65/00*** | (2006.01) |
| ***B29C 65/50*** | (2006.01) |
| ***B32B 38/04*** | (2006.01) |
| ***B65B 61/00*** | (2006.01) |

(52) U.S. Cl. ..... 156/516; 156/517; 156/250; 156/252; 156/253; 53/136.4

(58) Field of Classification Search ..... 156/250, 156/252, 256, 475, 477.1, 478–480, 486–489, 156/483, 516, 517; 30/336–339; 53/136.4
See application file for complete search history.

(56) References Cited

U.S. PATENT DOCUMENTS

| | | | | |
|---|---|---|---|---|
| 2,799,419 | A * | 7/1957 | Scheib | 156/353 |
| 4,640,731 | A * | 2/1987 | Lerner et al. | 156/355 |
| 6,571,848 | B2 * | 6/2003 | Tsuken et al. | 156/361 |

* cited by examiner

*Primary Examiner* — Mark A Osele
*Assistant Examiner* — Christopher C Caillouet
(74) *Attorney, Agent, or Firm* — Law Offices of Steven W. Weinrieb

(57) ABSTRACT

A spring tension control system for the front and rear application roller arms, and for the sealing tape application rollers mounted thereon, of a tape cartridge assembly of a case sealing machine comprises a first spring-biasing mechanism to control the disposition and movement of the front and rear application roller arms upon which are respectively mounted the front and rear case sealing tape application rollers for applying the sealing tape to the vertically oriented front and rear surface portions of the case. In addition, there is also provided a second spring biasing mechanism which operatively cooperates with the first spring biasing mechanism so as to effectively impart an enhanced amount of tension and speed to the rear case sealing application roller in order to achieve enhanced case sealing processing speeds.

14 Claims, 1 Drawing Sheet

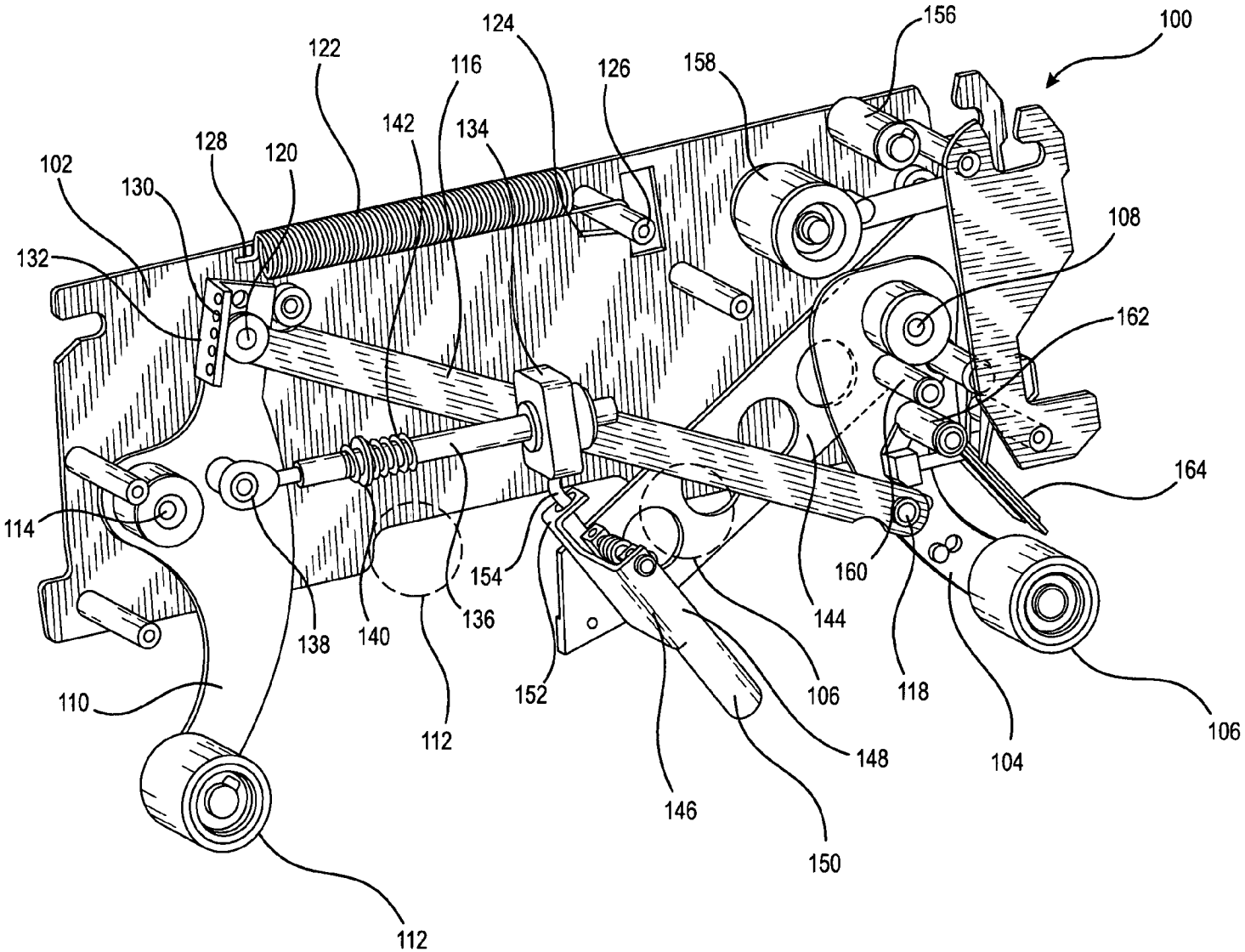
100
156
158
126
124
116
134
142
122
120
128
130
102
132
108
162
164
106
104
118
160
144
106
148
150
146
152
154
136
112
140
138
112
110
114

SPRING TENSION CONTROL SYSTEM FOR THE TAPE APPLICATION ROLLERS OF A TAPE ROLL DISPENSING CARTRIDGE ASSEMBLY

FIELD OF THE INVENTION

The present invention relates generally to carton or case sealing machines, and more particularly to a new and improved spring tension control system for the front and rear application roller arms, and for the sealing tape application rollers mounted thereon, of a tape cartridge assembly of the carton or case sealing machine wherein, in addition to the provision of a first spring-biasing mechanism, which is utilized to control the disposition and movement of the front application roller arm, upon which is mounted the front carton or case sealing tape application roller for applying the sealing tape to the vertically oriented front surface portion of the carton or case, as well as to simultaneously control the disposition and movement of the rear application roller arm, upon which is mounted the rear carton or case sealing tape application roller, for applying the sealing tape to the vertically oriented rear surface portion of the carton or case, there is also provided a second spring-biasing mechanism which effectively cooperates with the first spring biasing mechanism so as to impart an increased or enhanced amount of tension and speed to the rear application roller arm at a predetermined point in time of the carton or case sealing operational cycle so as to, in turn, effectively impart an increased or enhanced amount of tension and speed to the rear carton or case sealing application roller in order for the rear carton or case sealing tape application roller to in fact contact the vertically oriented rear surface portion of the carton or case with the proper degree of tension and speed in order to properly secure the rear tab portion of the sealing tape along the vertically oriented rear surface portion of the carton or case without permitting the rear tab portion of the sealing tape to experience any slack, or without permitting the rear tab portion of the sealing tape to become looped which would lead to the improper sealing of the rear tab portion of the sealing tape upon the vertically oriented rear surface portion of the carton or case. In this manner, increased or enhanced carton or case sealing processing speeds are in fact able to be attained or achieved.

BACKGROUND OF THE INVENTION

In connection with the operation of carton or case sealing machines, it is desirable to run or operate the carton or case sealing operation line at a relatively high rate of speed. It has been found, however, that in order to in fact achieve such relatively high processing speeds, the rear application roller arm, upon which is disposed the rear carton or case sealing tape application roller is mounted, must be actuated or moved at a predetermined point in time of the carton or case sealing operational cycle with an increased or enhanced amount of tension or speed such that the rear carton or case sealing tape application roller will in fact engage the vertically oriented rear surface portion of the carton or case with a high rate of speed in order that the rear carton or case sealing tape application roller can in fact properly apply the rear tab portion of the sealing tape onto the vertically oriented rear surface portion of the carton or case without permitting the rear tab portion of the sealing tape to experience any slack, or without permitting the rear tab portion of the sealing tape to become looped, whereby the carton or case would not in fact be properly sealed.

The problem, however, with simply increasing the tension applied or imparted to the rear application roller arm, upon which is disposed the rear carton or case sealing tape application roller, is that since the rear carton or case sealing tape application roller is operatively connected to the front carton or case sealing tape application roller, then the enhanced or increased tension is also imparted to the front application roller arm and, in effect, to the front carton or case sealing tape application roller. Applying or imparting such enhanced or increased pressure to, in effect, the front car-ton or case sealing tape application roller, however, is in fact problematic in that such enhanced or increased pressure, effectively applied or imparted to the front carton or case sealing tape application roller, will, in turn, be applied or imparted to, for example, the front and top surface portions of the carton or case. Normally, however, the corrugated box structure may not be inherently strong, or alternatively, the box, carton, or case may not be completely filled, or the particular contents with which the box, carton, or case is filled may not be sufficiently strong so as to effectively resist such added pressure. Accordingly, portions of the box, carton, or case may effectively be crushed, or alternatively, the application roller may simply be pushed through, for example, the upper surface portion of the box, carton, or case.

A need therefore exists in the art for a new and improved spring tension control system for the tape application rollers of a tape cartridge assembly which will permit an enhanced or increased amount of tension to in fact be able to be imparted to, or impressed upon, the rear application roller arm so as to, in effect, actuate the rear application roller arm, and the rear carton or case sealing application roller disposed thereon, with a higher rate of speed so as to permit enhanced or increased carton or case sealing processing speeds to be attained or achieved without encountering the aforenoted drawbacks of conventional spring-biased application roller arm control systems.

SUMMARY OF THE INVENTION

The foregoing and other objectives are achieved in accordance with the teachings and principles of the present invention through the provision of a new and improved spring tension control system for the front and rear application roller arms, and for the sealing tape application rollers mounted thereon, of a tape cartridge assembly of a carton or case sealing machine wherein, in addition to the provision of a first spring-biasing mechanism, which is utilized to control the disposition and movement of the front application roller arm, upon which is mounted the front carton or case sealing tape application roller for applying the sealing tape to the vertically oriented front surface portion of the carton or case, as well as to simultaneously control the disposition and movement of the rear application roller arm, upon which is mounted the rear carton or case sealing tape application roller, for applying the sealing tape to the vertically oriented rear surface portion of the carton or case, there is also provided a second spring-biasing mechanism which is effectively compressed after the front and rear application roller arms have been moved towards each other to a predetermined degree subsequent to the front carton or case sealing tape application roller being engaged by the vertically oriented front surface portion of the carton or case.

Subsequently, after the front carton or case sealing tape application roller has applied the sealing tape to the vertically oriented front surface portion of the carton or case, as well as to, for example, the horizontally oriented top surface portion of the carton or case, and after the front carton or case sealing tape application roller has effectively passed beyond the vertically oriented rear surface portion of the carton or case whereby the rear carton or case sealing tape application roller is now disposed immediately adjacent to the upper rear portion of the carton or case and is about to begin to pass beyond the vertically oriented rear surface portion of the carton or case, the second spring-biasing mechanism will effectively cooperate with the first spring-biasing mechanism so as to impart an increased or enhanced amount of tension and speed to the rear application roller arm so as to, in turn, effectively impart an increased or enhanced amount of tension and speed to the rear carton or case sealing application roller in order for the rear carton or case sealing tape application roller to in fact contact the vertically oriented rear surface portion of the carton or case with the proper degree of tension and speed in order to properly secure the rear tab portion of the sealing tape along the vertically oriented rear surface portion of the carton or case without permitting the rear tab portion of the sealing tape to experience any slack, or without permitting the rear tab portion of the sealing tape to become looped which would lead to the improper sealing of the rear tab portion of the sealing tape upon the vertically oriented rear surface portion of the carton or case. In this manner, increased or enhanced carton or case sealing processing speeds are in fact able to be attained or achieved.

BRIEF DESCRIPTION OF THE DRAWING

Various other features and attendant advantages of the present invention will be more fully appreciated from the following detailed description when considered in connection with the accompanying drawings in which like reference characters designate like or corresponding parts throughout the several views, and wherein:

The SOLE FIGURE is a perspective view of a new and improved spring tension control system, for the front and rear application roller arms, and for the sealing tape application rollers mounted thereon, of a tape cartridge assembly of a carton or case sealing machine, which has been constructed in accordance with the principles and teachings of the present invention and which shows the cooperative parts thereof.

DETAILED DESCRIPTION OF THE PREFERRED EMBODIMENT

Referring now to the drawings, and more particularly to the SOLE FIGURE thereof, a new and improved spring tension control system, for the front and rear application roller arms, and for the sealing tape application rollers mounted thereon, of a tape cartridge assembly of a carton or case sealing machine, which has been constructed in accordance with the principles and teachings of the present invention and which shows the cooperative parts thereof, is disclosed and is generally indicated by the reference character 100. More particularly, it is seen that the new and improved spring tension control system 100 comprises a main mounting plate 102 by means of which the entire spring tension control system 100 is mounted upon the framework of the carton or case sealing machine. A first front application roller arm 104, upon the lower end portion of which is mounted a front carton or case sealing tape application roller 106 for applying the sealing tape to the vertically oriented front surface portion of the carton or case, is pivotally mounted upon the main mounting plate 102 by means of a first pivot pin assembly 108, and a second rear application roller arm 110, up-on the lower end portion of which is mounted a rear carton or case sealing tape application roller 112 for applying the sealing tape to the vertically oriented rear surface portion of the carton or case, is pivotally mounted upon the main mounting plate 102 by means of a second pivot pin assembly 114.

A link bar 116 has a first end portion thereof pivotally connected to a central portion of the first front application roller arm 104 as at 118, while a second opposite end portion of the link bar 116 is pivotally connected to an upper end portion of the second rear application roller arm 110 as at 120 such that the link bar 116 operatively interconnects the first front and second rear application roller arms 104,110 together. Accordingly, it can be appreciated that when, for example, the front carton or case sealing tape application roller 106, mounted upon the first front application roller arm 104, encounters the vertically oriented front surface portion of the carton or case to be sealed with the sealing tape, the front carton or case sealing tape application roller 106 will initially be effectively pushed, by means of the vertically oriented front surface portion of the carton or case, toward the left, as viewed within the SOLE FIGURE, such that as a result of the pivotal movement of the first front application roller arm 104, in the clockwise direction, around its pivot axis as defined by means of its pivot pin assembly 108, the front carton or case sealing tape application roller 106 will effectively be moved along an arcuate path from its original or start position, as illustrated in solid lines within the SOLE FIGURE, to an end of movement position, as is illustrated in dotted lines within the SOLE FIGURE. Simultaneously therewith, it can be readily appreciated that, as a result of the aforenoted operative interconnection defined between the first front application roller arm 104 and the second rear application roller arm 110 by means of the link bar 116, the second rear application roller arm 110 will be pivotally moved in a counterclockwise direction around its pivot axis, as defined by means of its pivot pin assembly 114, such that the upper end portion of the second rear application roller arm 110 will be moved toward the left as viewed within the SOLE FIGURE while the lower end portion of the second rear application roller arm 110, upon which is mounted the rear carton or case sealing tape application roller 112, such that the rear carton or case sealing tape application roller 112 will effectively be moved along an arcuate path from its original or start position, as illustrated in solid lines within the SOLE FIGURE, to an end of movement position, as is illustrated in dotted lines within the SOLE FIGURE.

It is also seen that a first spring-biasing means, in the form of a coil spring 122, has a first end portion 124 engaged with a mounting pin 126 which is fixedly mounted upon the main mounting plate 102, while a second opposite end portion 128 of the first spring-biasing means 122 is adapted to be engaged within any one of, for example, five apertures 130 defined within a bracket 132 which is integrally mounted upon the second rear application roller arm 110. In this manner, when the first front application roller arm 104 and the second rear application roller arm 110 are pivotally moved from their original positions, at which the front carton or case sealing tape application roller 106 and the rear carton or case sealing tape application roller 112 are respectively illustrated by means of solid lines within the SOLE FIGURE, to their end of movement positions at which the front carton or case sealing tape application roller 106 and the rear carton or case sealing tape application roller 112 are respectively illustrated by means of dotted lines within the SOLE FIGURE, the first spring biasing means 122 will be expanded whereby the same will cause the first front application roller arm 104 and the second rear application roller arm 110, upon which the front carton or case sealing tape application roller 106 and the rear carton or case sealing tape application roller 112 are respectively mounted, to be returned to their original or start positions, as illustrated by means of the solid lines within the SOLE FIGURE, when the first spring biasing means 122 is permitted to contract back to its original state, as illustrated within the SOLE FIGURE, at a predetermined point of time of the tape sealing operational cycle as will be explained more fully hereinafter. It is lastly noted in connection with the first spring biasing means 122, and the connection of its second end portion 128 to the bracket 132 mounted upon the second rear application roller arm 110, that the provision of, for example, the five different apertures 130 defined within the bracket 132 permits the actual tension of the first spring-biasing means 122 to be operatively adjusted as desired.

Continuing further, in accordance with additional principles and teachings of the present invention, it is seen that a slide block 134 is movably mounted upon a guide rod 136, and that the left end portion of the guide rod 136 is pivotally connected to a substantially central portion of the second rear application roller arm 110 by means of a pivot pin assembly 138. The slide block 134 is pivotally connected to the link bar 116 by means of a pivot pin, not visible, which projects outwardly from, in effect, the back side of the slide block 134 so as to be disposed within an aperture, also not visible, which is defined within the link bar 116. In this manner, the slide block 134 is movable, along with the link bar 116, from its original or start position, as illustrated within the SOLE FIGURE, to an end of movement position when the link bar 116 is itself moved from its original or start position as illustrated within the SOLE FIGURE to its end of movement position which correlates with the angular or pivotal movements of the first front application roller arm 104 and the second rear application roller arm 110 having the front carton or case sealing tape application roller 106 and the rear carton or case sealing tape application roller 112 respectively mounted thereon, as has been previously described. Still yet further, it is also seen that a stop member 140, in the form of, for example, a washer, is fixedly secured at a predetermined location upon he guide rod 136, and a second spring biasing means 142, in the form of a coil spring, is fixedly disposed upon the guide rod 136 as a result of effectively having several coils thereof being operatively engaged with the stop member or washer 140.

Accordingly, when the slide block 134 is moved toward the left, as viewed within the SOLE FIGURE, from its original or start position to its end of movement position adjacent to the stop member or washer 140, the second spring biasing means 142 will be compressed so as to exert an increased or enhanced amount of biasing force, pressure, or tension upon the second rear application roller arm 110 for an operational purpose that will be explained more fully hereinafter. It is lastly noted that a knife support arm 144, as more fully described within copending patent application entitled QUICK CHANGE KNIFE BLADE ASSEMBLY FOR A TAPE ROLL DISPENSING CARTRIDGE ASSEMBLY OF A CASE SEALING MACHINE, is also pivotally mounted upon the main mounting plate 102, wherein the knife support arm 144 is adapted to have a downwardly extending or dependent knife blade or cutting member 146 fixedly mounted thereon, the knife support arm 144 being biased in a downward mode by a spring-biasing means, not shown, such that the knife support arm 144 is normally disposed at its lowered position as illustrated within the SOLE FIGURE. A knife blade guard or cover 148 is pivotally mounted upon the knife support arm 144 so as to be movable between a first position at which the knife blade guard or cover 148 covers the knife blade or cutting member 146 so as to protect operator or maintenance personnel, and a second position at which the knife blade guard or cover 148 effectively uncovers the knife blade or cutting member 146 so as to permit the knife blade or cutting member 146 to cut the sealing tape in order to, for example, effectively define a rear tab portion of the sealing tape which is adapted to be applied, by means of a wiping operation, onto the vertically oriented rear surface portion of the carton or case by means of the rear carton or case sealing tape application roller 112.

The knife blade guard or cover 148 is provided with a dependent tab member 150 which is adapted to be engaged by the carton or case to be sealed, as the carton or case is being moved along its tape sealing path, so as to effectively move the knife guard or cover 148 from its first position, at which the knife blade guard or cover 148 covers the knife blade or cutting member 146, to its second position at which the knife blade guard or cover 148 effectively uncovers the knife blade or cutting member 146, and it is also noted that the knife blade guard or cover 148 is also provided with an upstanding bracket member 152 within which there is defined an aperture, not clearly visible within the SOLE FIGURE. Correspondingly, the slide block 134 is provided with a dependent lug member 154 which is adapted to be engaged within the aperture, not visible, which is defined within the upstanding bracket member 152 when the slide block 134 is disposed at its original or start position as illustrated within the SOLE FIGURE. In this manner, the knife blade guard or cover 148 is effectively prevented from being moved from its covered position with respect to the knife blade or cutting member 146 to its uncovered position with respect to the knife blade or cutting member 146.

Alternatively, when the slide block 134 is moved toward the left from its original or start position to its end of movement position, as viewed within the SOLE FIGURE, such as, for example, when the link bar 116 is moved from its original or start position, as illustrated within the SOLE FIGURE, to its end of movement position in correlation with the angular or pivotal movements of the first front application roller arm 104 and the second rear application roller arm 110, having the front carton or case sealing tape application roller 106 and the rear carton or case sealing tape application roller 112 respectively mounted thereon, as has been previously described, the lug member 154 will be disengaged from the aperture, not visible, defined within the up-standing backet member 152 of the knife blade guard or cover 148. In this manner, the knife blade guard or cover 148 will be permitted to be moved to its uncovered position with respect to the knife blade or cutting member 146 so as to, in turn, permit the knife blade or cutting member 146 to perform its sealing tape cutting function at the predetermined point in time of the carton or case sealing operation.

Having described substantially all of the structural components comprising the new and improved spring tension control system 100 of the present invention, a brief operational cycle of the new and improved spring tension control system 100 of the present invention will now be described. More particularly, it is firstly noted that a leading end tab portion of the carton or case sealing tape is adapted to be routed, for example, from a tape supply roll, not shown, around a right external peripheral side surface portion of a first idler roller 156, beneath a lower external peripheral surface portion of the first idler roller 156, over an upper external peripheral surface portion of a second idler roller 158, and around a left external peripheral side surface portion of the second idler roller 158. From the second idler roller 158, the leading end tab portion of the carton or case sealing tape is conducted between third and fourth idler rollers 160,162 so as to effectively be conducted onto a guide plate 164 such that the free end portion of the leading end tab portion of the carton or case sealing tape will be disposed upon or alongside the right external peripheral side surface portion of the front carton or case sealing tape application roller 106. In this manner, the leading end tab portion of the carton or case sealing tape will effectively be interposed or sandwiched between the right external peripheral side surface portion of the front carton or case sealing tape application roller 106 and the vertically oriented front surface portion of the carton or case, when the vertically oriented front surface portion of the carton or case engages the front carton or case sealing tape application roller 106.

Subsequently, as the carton or case is then conveyed in the conveyance direction, which extends from right to left as viewed within the SOLE FIGURE, the front carton or case sealing tape application roller 106 will, in effect, be forced toward the left, as viewed within the SOLE FIGURE, and will also begin to move upwardly along the vertically oriented front surface portion of the carton or case, as the conveyed carton or case effectively pushes the front carton or case sealing tape application roller 106 out of its way whereby the front carton or case sealing tape application roller 106 will effectively apply the leading end tab portion of the carton or case sealing tape onto the vertically oriented front surface portion of the carton or case by means of a wiping action. As a result of the aforenoted movement of the front carton or case sealing tape application roller 106, the first front application roller arm 104 will be forced to rotate in the clockwise direction around its pivot pin assembly 108 thereby causing the link bar 116 to effectively be moved toward the left and to be simultaneously rotated a predetermined amount, in the counterclockwise direction, around a pivot axis effectively defined by means of its connection to the slide block 134 and as respectively permitted by means of the pivotal connections 118,120 defined between the opposite ends of the link bar 116 and the first and second front and rear application roller arms 104,110. In addition, since the second rear application roller arm 110 is operatively connected to the first front application roller arm 104 by means of the link bar 116, the second rear application roller arm 110 will be pivoted or rotated in the counterclockwise direction around its pivot pin assembly 114 whereby the second carton or case sealing tape application roller 112 will begin to move upwardly and toward the first carton or case sealing tape application roller 106 until both of the front and rear carton or case sealing tape application rollers 106, 112 ultimately reach their end of movement positions, as illustrated by means of the dotted lines within the SOLE FIGURE, at which point in time the front carton or case sealing tape application roller 106 will be disposed upon the horizontally oriented upper surface portion of the carton or case while the second carton or case sealing tape application roller 112 will be disposed at a position which is spaced just above the upper surface portion of the carton or case. As a result of such movements, the front carton or case sealing tape application roller 106 will be able to wipe the carton or case sealing tape along the upper surface portion of the carton or case in the direction extending from the vertically oriented front surface portion of the carton or case toward the vertically oriented rear surface portion of the carton or case as the carton or case is being continuously conveyed along its conveyance path which is now, in effect, disposed beneath the front and rear carton or case sealing tape application rollers 106,112.

It is also to be noted at this point in time that in view of the substantially leftward movement of the link bar 116, and its operative connection to the slide block 134, the slide block 134 will be moved along the guide rod 136 such that the dependent lug member 154 of the slide block 134 will be disengaged from the aperture formed within the bracket member 152 of the knife blade guard or cover 148. In this manner, as the carton or case is being conveyed along its conveyance path, the upper portion of the vertically oriented front surface portion of the carton or case will encounter the tab member 150 of the knife blade guard or cover 148 so as to effectively pivot the same to its uncovered position thereby uncovering or exposing the knife blade or cutting member 146. In addition, the vertically oriented front surface portion of the carton or case will also encounter the knife support arm 144 so as to effectively move the same, along with the knife blade or cutting member 146 and the knife blade guard or cover 148 mounted thereon, to an elevated position, against its spring-biasing means, for a purpose to be explained hereinafter and which is also described within the aforenoted copending patent application entitled QUICK CHANGE KNIFE BLADE ASSEMBLY FOR A TAPE ROLL DISPENSING CARTRIDGE ASSEMBLY OF A CASE SEALING MACHINE.

Subsequently, as the front carton or case sealing tape application roller 106 approaches the upper rear edge portion of the carton or case, and in view of the fact that the front carton or case sealing tape application roller 106 is disposed at its dotted line position as illustrated within the SOLE FIGURE, whereby the front carton or case sealing tape application roller 106 is seen to be disposed immediately adjacent to the uncovered or exposed knife blade or cutting member 146, the front carton or case sealing tape application roller 106 will, in effect, fall off or be disengaged from the upper surface portion of the carton or case, and immediately thereafter, the knife support arm 144 will likewise, in effect, fall off or be disengaged from the upper surface portion of the carton or case. In view of the aforenoted spring-biasing of the knife support arm 144, the knife support arm 144 will now be biased back toward its original lowered position as illustrated within the SOLE FIGURE, whereby the knife blade or cutting member 146 can cut or sever the carton or case sealing tape thereby forming a rear tab portion of the carton or case sealing tape which is to be applied along the vertically oriented rear surface portion of the carton or case by means of a wiping action performed by means of the rear carton or case sealing tape application roller 112.

It is to be noted that since both the front carton or case sealing tape application roller 106 and the knife support arm 144 are no longer engaged with or disposed upon the upper surface portion of the carton or case being sealed, the rear carton or case sealing tape application roller 112 is able to, in effect, be lowered into engagement with the upper surface portion of the carton or case being sealed so as to in fact perform its sealing function with respect to rear tab portion of the carton or case sealing tape along the vertically oriented rear surface portion of the carton or case. It is also to be noted that since the rear carton or case sealing tape application roller 112 is at this point in time disposed at its dotted line position, as illustrated within the SOLE FIGURE, whereby the rear carton or case sealing tape application roller 112 will also be disposed immediately adjacent to the left end portion of the knife support arm 144 and the knife blade or cutting member 146, then when the knife support arm 144 and the knife blade or cutting member 146 move to their lowered positions at which the knife blade or cutting member 146 cuts or severs the sealing tape in order to form the aforenoted rear tab portion of the sealing tape, the rear carton or case sealing tape application roller 112 will be substantially disposed at the upper rear edge or corner region of the carton or case. Still further, in view of the aforenoted disengagement of the front carton or case sealing tape application roller 106 from the upper surface portion of the carton or case, and the commencement of the downward movement thereof through, in effect, its return stroke or movement between its dotted line position and its solid line position, the second spring biasing means 142, which is disposed upon the guide rod 136 and which was previously compressed by means of the slide block 134 when the slide block 134 was moved from its rightwardmost position, illustrated within the SOLE FIGURE, to its leftwardmost position adjacent to the stop member 140, will now tend to expand back toward its normally non-compressed state.

It is interesting to note, however, that the expansion of the second spring-biasing means 142 back toward its normally non-compressed state does not directly cause the second rear application roller arm 110 to move with an increased or enhanced amount of speed in the clockwise direction so as to, in turn, cause the rear carton or case sealing tape application roller 112 to rapidly move toward the left and back to its original position, as illustrated in solid lines as viewed within the SOLE FIGURE, so as to rapidly engage and apply the rear tab portion of the sealing tape onto the vertically oriented rear surface portion of the carton or case by means of the aforenoted wiping action. In fact, such rapid clockwise movement of the second rear application roller arm 110, and the consequent rapid leftward movement of the rear carton or case sealing tape application roller 112, is accomplished, in effect, indirectly as a result of the expansion of the second spring-biasing means 142.

More particularly, when the rear carton or case sealing tape application roller 112 is disposed at its dotted line position as illustrated within the SOLE FIGURE, the pivot pin assembly 138, operatively connecting the left end portion of the guide rod 136 to the second rear application roller arm 110, will, in effect, be disposed above the pivot pin assembly 114, by means of which the second rear application roller arm 110 is pivotally mounted upon the main mounting plate 102, as a result of the angular movement of the second rear application roller arm 110 around its pivot pin assembly 114 as the rear carton or case sealing tape application roller 112 is moved from its original solid line position as illustrated within the SOLE FIGURE to its dotted line position as illustrated within the SOLE FIGURE. Accordingly, when the second spring biasing means 142 undergoes its expansion, if the expansion force of the same was directed toward the left so as to be imparted directly toward the second rear application roller arm 110, as viewed in the SOLE FIGURE, it would be oriented along a direction which would not in fact tend to move the second rear application roller arm 110 in the clockwise direction so as to in fact return the second rear application roller arm 110, and the rear carton or case sealing tape application roller 112 to its original solid line position.

In fact, therefore, the expansion force of the second spring biasing means 142 operates or acts, in effect, in conjunction with the contraction forces of the first spring biasing means 122, which was previously expanded when the front and rear carton or case sealing tape application rollers 106, 112 were moved from their solid line positions to their dotted line positions as illustrated within the SOLE FIGURE, so as to be quickly imparted to and impressed upon the slide block 134 in order to quickly move the same along the guide rod 136 back toward its original position, as illustrated within the SOLE FIGURE. In this manner, the link bar 116 will be rapidly returned to its original position, as illustrated within the SOLE FIGURE, under the influence of both the contraction force of the first spring-biasing means 122 and the expansion force of the second spring-biasing means 142, such that the left end portion of the link bar 116, which is pivotally connected to the upper end portion of the second rear application roller arm 110, will, in effect, act upon the upper end portion of the second rear application roller arm 110 so as to cause the same to be rapidly rotated in the clockwise direction so as to in fact rapidly move the rear carton or case sealing tape application roller 112 in the leftward direction, back toward its original position as illustrated within the SOLE FIGURE, for its rapid engagement with the rear tab portion of the sealing tape in order to quickly and properly apply the same onto the vertically oriented rear surface portion of the carton or case being sealed.

Thus, it may be seen that a new and improved spring tension control system for the front and rear application roller arms, and for the sealing tape application rollers mounted thereon, of a tape cartridge assembly of the carton or case sealing machine has been disclosed wherein a first spring-biasing mechanism is utilized to control the disposition and movement of the front application roller arm upon which is mounted a front carton or case sealing tape application roller for applying the sealing tape to the vertically oriented front surface portion of the carton or case, and to simultaneously control the disposition and movement of the rear application roller arm upon which is mounted the rear carton or case sealing tape application roller for applying the sealing tape to the vertically oriented rear surface portion of the carton or case. In addition, there is also provided a second spring biasing mechanism which operatively cooperates with the first spring biasing mechanism so as to effectively impart an increased or enhanced amount of tension and speed to the rear application roller arm at a predetermined point in time of the carton or case sealing operational cycle. In this manner, an increased or enhanced amount of tension and speed is effectively imparted to the rear carton or case sealing application roller in order for the rear carton or case sealing tape application roller to in fact contact the vertically oriented rear surface portion of the carton or case with the proper degree of tension and speed in order to properly secure the rear tab portion of the sealing tape along the vertically oriented rear surface portion of the carton or case. Accordingly, increased or enhanced carton or case sealing processing speeds are in fact able to be attained or achieved.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A spring tension control system for the tape application rollers of a case sealing machine, comprising:

a framework;

a pair of tape application roller arms movably mounted upon said framework;

a pair of tape application rollers, mounted upon said pair of tape application roller arms, for applying tape to forward and rearward portions of a case to be sealed;

a linkage operatively linking said pair of tape application roller arms together such that said pair of tape application rollers, disposed upon said pair of tape application roller arms, are moved together between first inoperative start positions at which said pair of tape application rollers are not applying tape to the case to be sealed, and second operative positions at which said pair of application rollers are applying tape to the case to be sealed;

a slide block operatively connected to said linkage so as to be movable with said linkage between said first inoperative start positions at which said pair of tape application rollers are not applying tape to the case to be sealed, and said second operative positions at which said pair of application rollers are applying tape to the case to be sealed;

a first spring interconnecting one of said pair of tape application roller arms to said framework for returning said pair of tape application rollers from said second operative positions back toward said first inoperative positions; and a second spring operatively interconnecting one of said pair of tape application roller arms to said slide block for rapidly moving said slide block, said linkage, and said one of said pair of tape application rollers arms having one of said pair of tape application rollers disposed thereon, that is applying tape to the rearward portion of the case being sealed, back toward said first inoperative start position so as to ensure that said one of said pair of tape application rollers, that is applying tape to the rearward portion of the case being sealed, is rapidly returned toward said original inoperative position so as to ensure that a trailing edge portion of the tape, being applied to the rearward portion of the case being sealed, is properly applied to the rearward portion of the case being sealed.

2. The spring tension control system as set forth in claim 1, wherein:

said linkage comprises a link bar having opposite end portions thereof respectively connected to said pair of tape application roller arms.

3. The spring tension control system as set forth in claim 2, further comprising:

an aperture defined within said link bar; and said slide block is operatively connected to said link bar by a pin disposed within said aperture defined within said link bar.

4. The spring tension control system as set forth in claim 3, further comprising:

a guide rod;

said slide block being slidably mounted upon said guide rod from a first position, corresponding to said first positions of said pair of tape application rollers, to a second position corresponding to said second positions of said pair of tape application rollers.

5. The spring tension control system as set forth in claim 4, further comprising:

a stop member disposed upon said guide rod wherein said second spring is interposed between said slide block and said stop member.

6. The spring tension control system as set forth in claim 5, wherein:

said second spring is compressible by said slide block when slide block is moved from said first position to said second position; and said second spring is expansible as said pair of tape application rollers are moved from said second positions back to said first positions so as to cause said slide block to rapidly move from said second position back toward first position and thereby cause said link bar to be moved back toward said first position which, in turn, causes one of said pair of tape application roller arms, upon which said one of said pair of tape application rollers, that is applying tape to the rearward portion of the case being sealed, is disposed, to be rapidly returned toward said original position so as to ensure that a trailing edge portion of the tape, being applied to the rearward portion of the case being sealed, is properly applied to the rearward portion of the case being sealed.

7. The spring tension control system as set forth in claim 4, wherein:

a first end portion of said guide rod is operatively connected to said link bar as a result of said slide block being slidably disposed upon said guide rod and said slide block being operatively connected to said link bar; and a second end portion of said guide rod is operatively connected to said one of said pair of tape application roller arms upon which said one of said pair of tape application rollers is disposed that is applying tape to the rearward portion of the case being sealed.

8. A case sealing machine having a spring tension control system for tape application rollers of said case sealing machine, comprising:

a framework;

a pair of tape application roller arms movably mounted upon said framework;

a pair of tape application rollers, mounted upon said pair of tape application roller arms, for applying tape to forward and rearward portions of a case to be sealed;

a linkage operatively linking said pair of tape application roller arms together such that said pair of tape application rollers, disposed upon said pair of tape application roller arms, are moved together between first inoperative start positions at which said pair of tape application rollers are not applying tape to the case to be sealed, and second operative positions at which said pair of application rollers are applying tape to the case to be sealed;

a slide block operatively connected to said linkage so as to be movable with said linkage between said first inoperative start positions at which said pair of tape application rollers are not applying tape to the case to be sealed, and said second operative positions at which said pair of application rollers are applying tape to the case to be sealed;

a first spring interconnecting one of said pair of tape application roller arms to said framework for returning said pair of tape application rollers from said second operative positions back toward said first inoperative positions; and a second spring operatively interconnecting one of said pair of tape application roller arms to said slide block for rapidly moving said slide block, said linkage, and said one of said pair of tape application rollers arms having one of said pair of tape application rollers disposed thereon, that is applying tape to the rearward portion of the case being sealed, back toward said first inoperative start position so as to ensure that said one of said pair of tape application rollers, that is applying tape to the rearward portion of the case being sealed, is rapidly returned toward said original inoperative position so as to ensure that a trailing edge portion of the tape, being applied to the rearward portion of the case being sealed, is properly applied to the rearward portion of the case being sealed.

9. The case sealing machine as set forth in claim 8, wherein:

said linkage comprises a link bar having opposite end portions thereof respectively connected to said pair of tape application roller arms.

10. The case sealing machine as set forth in claim 9, further comprising:

an aperture defined within said link bar; and said slide block is operatively connected to said link bar by a pin disposed within said aperture defined within said link bar.

11. The case sealing machine as set forth in claim 10, further comprising:

a guide rod;

said slide block being slidably mounted upon said guide rod from a first position, corresponding to said first positions of said pair of tape application rollers, to a second position corresponding to said second positions of said pair of tape application rollers.

12. The case sealing machine as set forth in claim 11, further comprising:

a stop member disposed upon said guide rod wherein said second spring is interposed between said slide block and said stop member.

13. The case sealing machine as set forth in claim 12, wherein:

said second spring is compressible by said slide block when slide block is moved from said first position to said second position; and said second spring is expansible as said pair of tape application rollers are moved from said second positions back to said first positions so as to cause said slide block to rapidly move from said second position back toward first position and thereby cause said link bar to be moved back toward said first position which, in turn, causes one of said pair of tape application roller arms, upon which said one of said pair of tape application rollers, that is applying tape to the rearward portion of the case being sealed, is disposed, to be rapidly returned toward said original position so as to ensure that a trailing edge portion of the tape, being applied to the rearward portion of the case being sealed, is properly applied to the rearward portion of the case being sealed.

14. The case sealing machine as set forth in claim 11, wherein:

a first end portion of said guide rod is operatively connected to said link bar as a result of said slide block being slidably disposed upon said guide rod and said slide block being operatively connected to said link bar; and a second end portion of said guide rod is operatively connected to said one of said pair of tape application roller arms upon which said one of said pair of tape application rollers is disposed that is applying tape to the rearward portion of the case being sealed.

* * * * *